United States Patent [19]

Scott

[11] Patent Number: 4,920,592

[45] **Date of Patent: * May 1, 1990**

[54] COMBINATION HOOD SUPPORT, JACK CRANK, LUG WRENCH AND WHEEL COVER REMOVAL APPARATUS

[76] Inventor: Robert S. Scott, 3043 W. Clinton, Phoenix, Ariz. 85029

[ * ] Notice: The portion of the term of this patent subsequent to Mar. 14, 2006 has been disclaimed.

[21] Appl. No.: 321,899

[22] Filed: Mar. 10, 1989

Related U.S. Application Data

[63] Continuation-in-part of Ser. No. 205,476, Jun. 13, 1988, Pat. No. 4,811,440.

[51] Int. Cl.[5] ..... B25F 1/00

[52] U.S. Cl. ..... 7/100; 7/138

[58] Field of Search ..... 7/100, 138, 170; 81/177.2, 121.1; 29/245, 273; 180/69.21

[56] References Cited

U.S. PATENT DOCUMENTS

| | | | |
|---|---|---|---|
| 3,649,976 | 3/1972 | Isom | 7/100 |
| 3,779,106 | 12/1973 | Cavicchi | 7/100 |
| 4,586,579 | 5/1986 | Matsui et al. | 180/69.21 |
| 4,607,406 | 8/1986 | Davis, Jr. | 7/138 |
| 4,765,009 | 8/1988 | Hung | 7/100 |
| 4,811,440 | 3/1989 | Scott | 7/100 |

FOREIGN PATENT DOCUMENTS

| | | | |
|---|---|---|---|
| 1496524 | 12/1977 | United Kingdom | 81/121.1 |
| 2142268 | 1/1985 | United Kingdom | 81/121.1 |

*Primary Examiner*—Roscoe V. Parker

*Attorney, Agent, or Firm*—H. Gordon Shields

[57] ABSTRACT

Combination hood support for supporting the hood of an automotive vehicle includes a lug wrench and wheel cover/hub cap pry tool portion and a hood support rod portion which may be secured together for use as a jack crank. The apparatus is normally stowed or stored beneath the hood of the vehicle and the rod portion pivots into its hood support functional position. The two portions are removed from their stowed or stored location(s) for use as a jack crank.

8 Claims, 2 Drawing Sheets

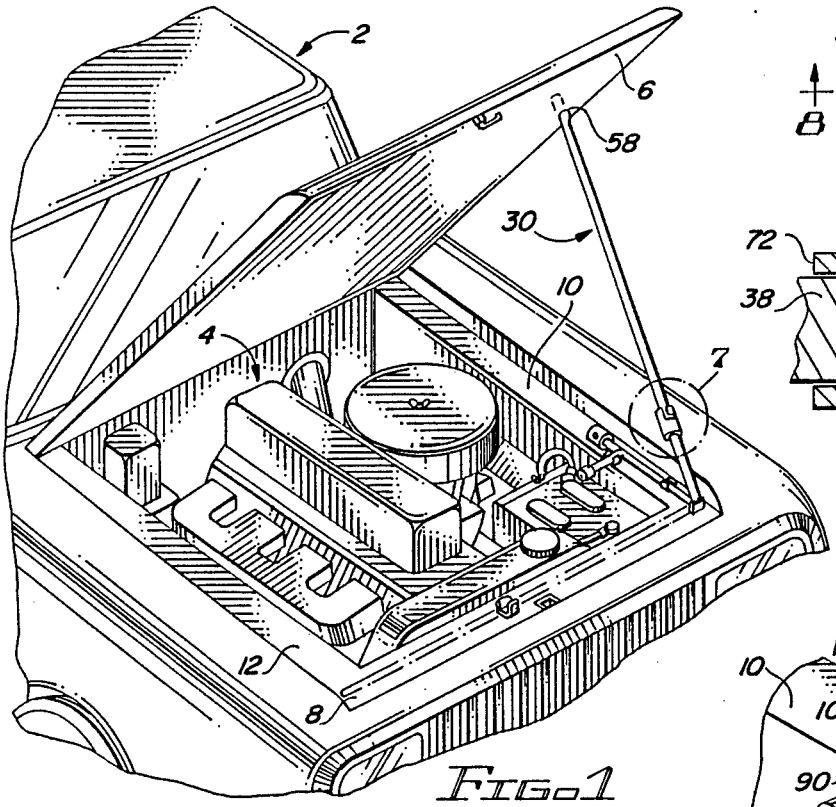
FIG. 1
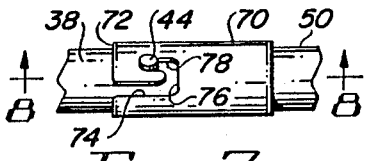
FIG. 7
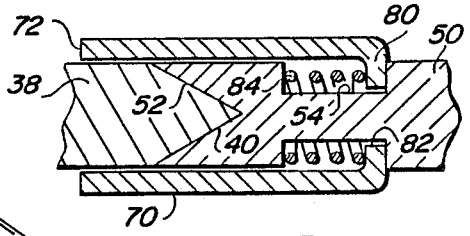
FIG. 8
FIG. 6
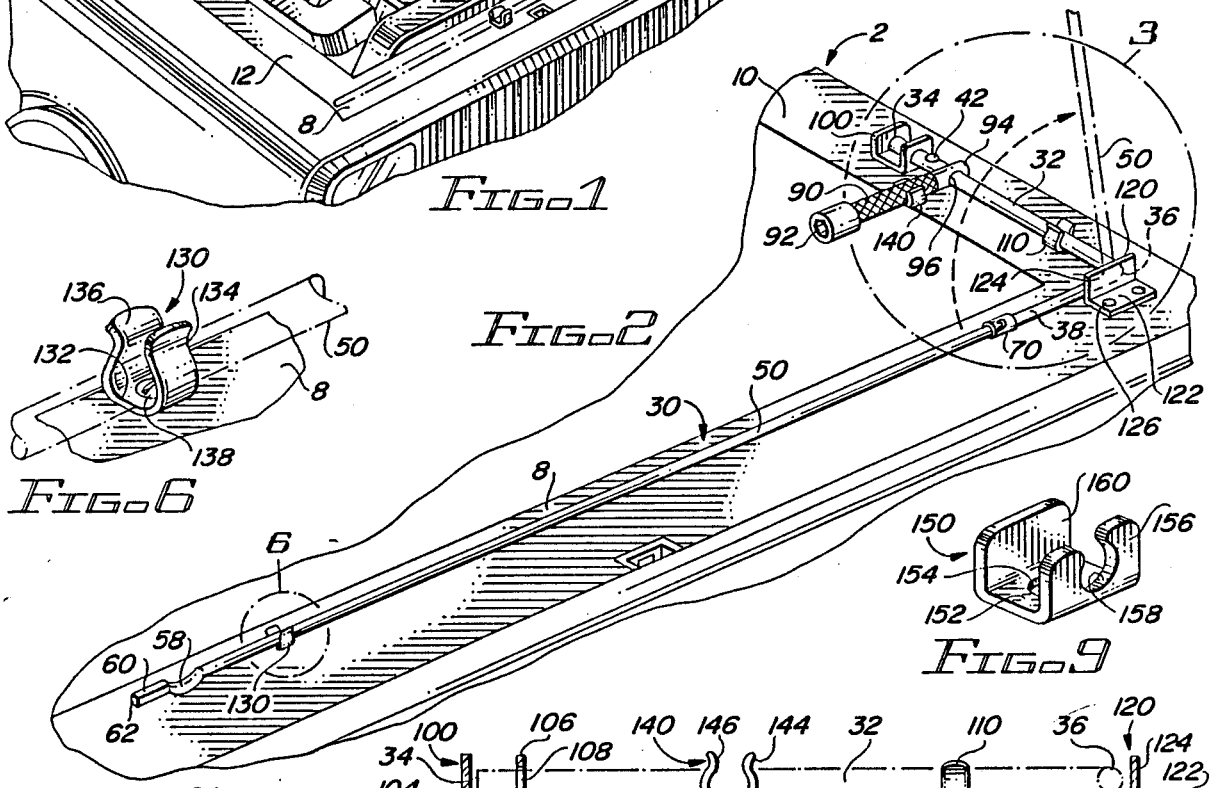
FIG. 2
FIG. 9
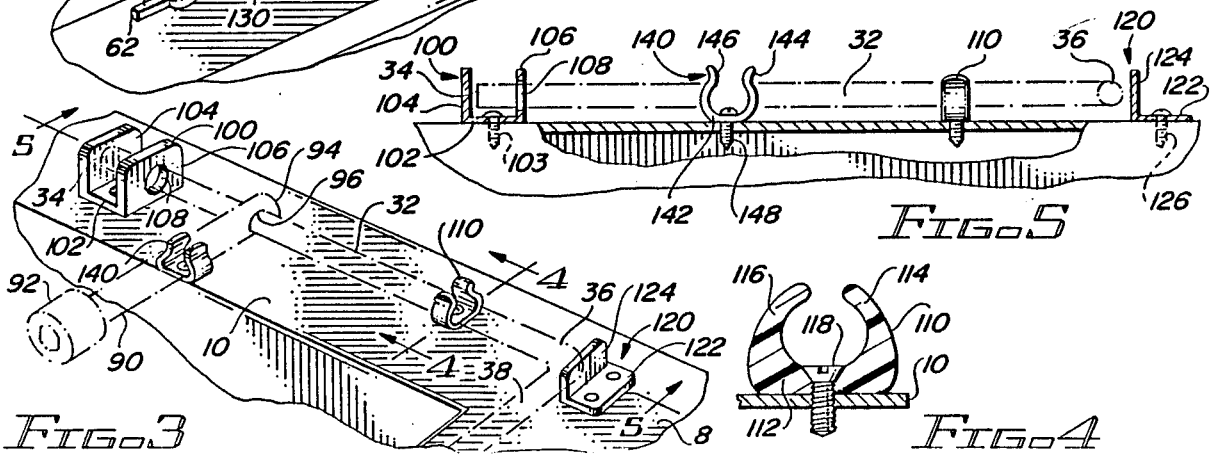
FIG. 3
FIG. 5
FIG. 4

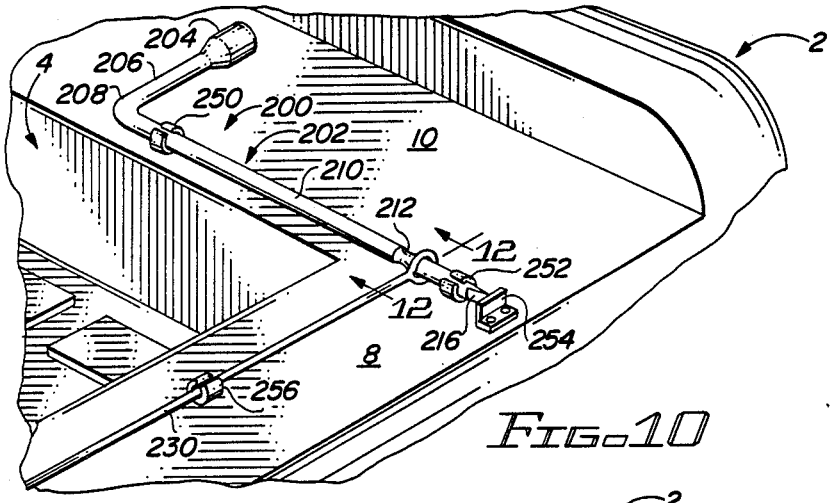
FIG. 10
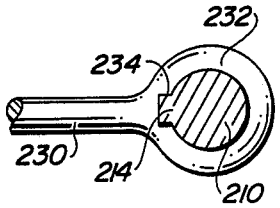
FIG. 12
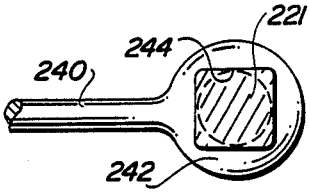
FIG. 14
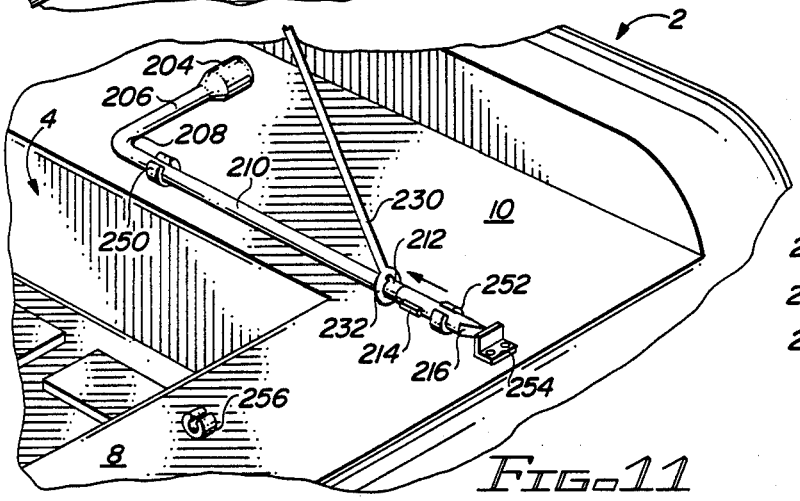
FIG. 11
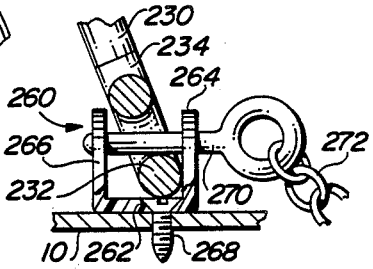
FIG. 16
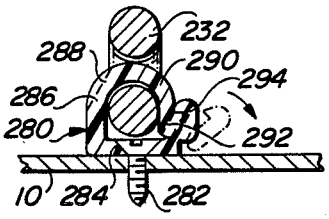
FIG. 17
FIG. 13
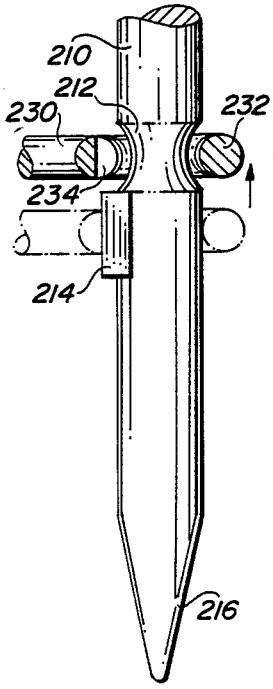
FIG. 15
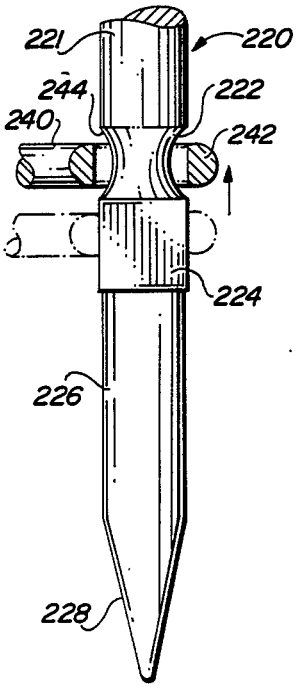
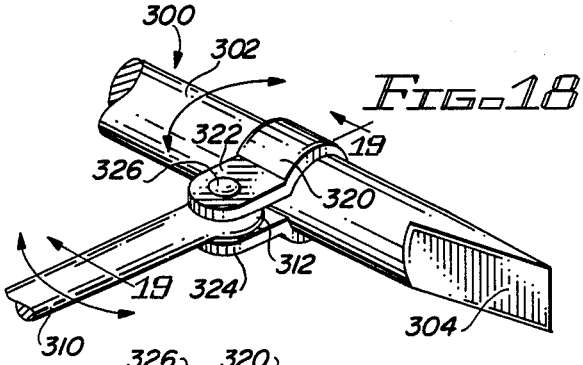
FIG. 18
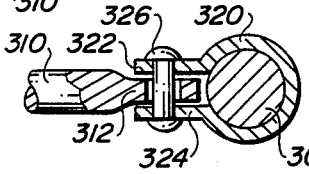
FIG. 19

COMBINATION HOOD SUPPORT, JACK CRANK, LUG WRENCH AND WHEEL COVER REMOVAL APPARATUS

CROSS-REFERENCE TO RELATED APPLICATION

This application is a continuation-in-part application of Ser. No. 205,476filed Jun. 13, 1988, now U.S. Pat. No. 4,811,440, dated Mar. 14, 1989.

BACKGROUND OF THE INVENTION

1. Field of the Invention:

This invention relates to automotive vehicles, and more particularly, to a combination tool which includes a hood support element, jack crank element, a lug wrench, and a pry element for removing hub caps and wheel covers, for use in and with automotive vehicles.

2. Description of the Prior Art:

Combination tools for automotive vehicles are not new. For example, it is not uncommon to find combination tools used for changing wheels, as for example, a combination lug wrench and wheel cover removal tool. Moreover, it is not uncommon to find a combination of jack crank and lug wrench. However, the jack crank in such cases is generally limited to the ratchet type bumper jacks, and the like. That type of jack includes a base and a jack element that moves upwardly or downwardly through ratcheting action.

For automotive vehicles in contemporary usage, particularly with compact vehicles, pickup trucks and the like, scissors jacks, or screw jacks are relatively common. These kinds of jacks require a rotary motion for raising and lowering them, rather than a pumping action or pivoting action as is common with bumper jacks. The scissors type or screw type jacks require a substantially greater lever arm than is required by the bumper jacks.

U.S. Pat. No. 3,649,976 (Isom) discloses a combination tool for use with vehicle wheels. The tool combines the function of a lug wrench, jack handle, and wheel cover removal tool. Moreover, the tool has a flange and an aperture through the flange which receives a bolt for locking the spare tire and the tool in place.

U.S. Pat. No. 3,779,106 (Cavicchi) discloses a combination lug wrench, wheel cover remover tool, and bumper jack crank.

U.S. Pat. No. 4,586,579 (Matsui et al) discloses a particular structure for supporting a hood. The apparatus is not a combination tool, but rather is specifically designed to support the hood of an automotive vehicle.

U.S. Pat. No. 4,607,406 (Davis, Jr.) discloses a combination tool which includes the combination of a socket wrench for removing lug bolts and a crank handle at the opposite end of the tool from the socket wrench. The lug wrench portion and the crank handle portion both pivot or fold to provide additional leverage for the respective functions. In addition, the central portion of the combination tool is also foldable for storage purposes and it locks in the open, extended position when the apparatus is used either as a lug wrench or as a jack handle. The overall length of the apparatus, and the folding elements, renders the apparatus usable as a jack handle for screw jacks.

U.S. Pat. No. 4,765,009 (Hung) discloses a multi-functional bar which can be used as a jack handle, a screw driver, and an adjustable socket wrench by fastening various elements to the base bar. The various elements are attached to the base bar by various means, such as sleeve elements, and the like.

SUMMARY OF THE INVENTION

The invention described and claimed herein comprises a tool which is a combination hood support rod, crank for a scissors jack or screw jack, a lug wrench, and a pry tool for removing wheel covers/hub caps. The tool includes an elongated element and a relatively short arm bent at a predetermined angle, which is about 90°, and the apparatus pivots from a storage position upwardly to a hood support position, with the elongated element supporting the hood. The apparatus is removable from the engine compartment when it is used as a jack handle and lug wrench. Removed from the engine compartment, the tool may be separated to use the lug wrench tool portion and the hub cap/wheel cover tool portion. The bent or angled portion may also include a pivoting crank arm to facilitate the use of the apparatus as a jack handle. Appropriate clamp elements in the engine compartment allow for the apparatus to be stowed in place, allow it to be pivoted and retained in its hood support operative position, and allow it to be easily removed for use as a jack crank and lug wrench.

Among the objects of the present invention are the following:

- To provide new and useful combination tool apparatus;
- To provide new and useful tool apparatus combining the functions of supporting a hood, cranking a jack, and removing and replacing a wheel and wheel cover;
- To provide new and useful apparatus for supporting a hood of an automotive vehicle;
- To provide a new and useful apparatus for removing an automobile's wheel and wheel cover;
- To provide new and useful apparatus for cranking a jack with a rotary movement;
- To provide new and useful combination tool apparatus movable in an engine compartment of an automotive vehicle from a stowed position to a hood support position and removable from the engine compartment for use as a crank handle;
- To provide new and useful tool apparatus for removing hub caps/wheel covers from an automotive vehicle;
- To provide new and useful tool apparatus for removing lug nuts from vehicle wheels; and
- To provide new and useful combination tool apparatus for supporting a hood, cranking a jack, removing lug nuts, and removing wheel covers/hub caps.

BRIEF DESCRIPTION OF THE DRAWING

FIG. 1 is a perspective view of the apparatus of the present invention in its use environment.

FIG. 2 is an enlarged perspective view of the apparatus of the present invention.

FIG. 3 is an enlarged perspective view of a portion of the apparatus of the present invention taken generally from Circle 3 of FIG. 2.

FIG. 4 is an enlarged view in partial section taken generally along line 4—4 of FIG. 3.

FIG. 5 is a view in partial section taken generally along line 5—5 of FIG. 3.

FIG. 6 is an enlarged perspective view of a portion of the apparatus of the of the present invention, taken generally from circle 6 of FIG. 2.

FIG. 7 is an enlarged view of a portion of the apparatus of the present invention taken generally from Circle 7 of FIG. 1.

FIG. 8 is a view in partial section taken generally along line 8—8 of FIG. 7.

FIG. 9 is an enlarged perspective view of an element useful with the apparatus of the present invention.

FIG. 10 is a perspective view of an alternate embodiment of the apparatus of the present invention.

FIG. 11 is a perspective view showing the apparatus of FIG. 10 in a use environment.

FIG. 12 is a view in partial section taken generally along line 12—12 of FIG. 10.

FIG. 13 is a top view of a portion of the apparatus of FIGS. 10, 11, and 12.

FIG. 14 is a side view in partial section of an alternate embodiment of the elements illustrated in FIG. 12.

FIG. 15 is a top view of the apparatus illustrated in FIG. 14.

FIG. 16 is an end view of alternate fastening elements usable with the apparatus of FIGS. 10—15.

FIG. 17 is a view in partial section of an alternate embodiment of the elements illustrated in FIG. 16.

FIG. 18 is a perspective view of another alternate embodiment of the apparatus of the present invention.

FIG. 19 is a view in partial section taken generally along line 19—19 of FIG. 18.

DESCRIPTION OF THE PREFERRED EMBODIMENT

FIG. 1 is a perspective view of the front portion of a vehicle 2, illustrating a combination tool apparatus 30 of the present invention in one of its use settings or positions. The vehicle 2 includes a front engine compartment 4 and a hood 6. The hood 6 is supported in its "up" position by the apparatus 30. At the front of the engine compartment 4, and beneath the hood 6, are, insofar as they relate to the apparatus of the present invention, three sheet metal portions. The sheet metal portions are respectively designated as a front sheet metal apron 8, a left side sheet metal apron 10, and a right side sheet metal apron 12. As is well known and understood, the hood 6 latches, and is accordingly secured, in its "down" position to the front apron 8. When the hood is open, the side aprons 10 and 12 are exposed and are accessible. The apparatus 30 of the present invention is disposed, in its down or stowed/storage position, on both the front apron 8 and the left side apron 10.

The apparatus 30 of the present invention is a multifunctional apparatus which includes several discrete portions and some of the portions are separable or removable to enable them to be used to perform their separate functions, as desired, or as required.

FIG. 2 is a perspective view of an apron 8 and of the apron 10, with the apparatus 30 shown disposed thereon. FIG. 3 is an enlarged view of a portion of the apron 12, taken generally from Circle 3 of FIG. 2.

The apparatus 30 includes a base member or rod 32, disposed generally along the apron 10. The base member or rod 32 includes an elbow 36, and an arm extending substantially ninety degrees to the base member or rod 32. The arm 38 is in turn appropriately secured, as will be discussed in detail below, to an extension member or rod 50. The rod portions 38 and 50 are disposed on the apron 8, as best shown in FIG. 2, in the stowed position. For supporting the hood 6 in its up position, the rod portions 38 and 50 are pivoted upwardly from the apron 8.

Towards the outer end of the extension member 50, remote from the elbow 36, is a support bow 58. As best shown in FIG. 1, the support bow 58 cooperates with an appropriate structural portion of the hood 6 to enable the apparatus 30 to support the hood 6.

Adjacent to the support bow 58 is a square tip portion 60. The square tip portion 60 terminates in a flat end 62. As will be understood, the square tip portion 60 may also be of a hexagonal configuration, or any other appropriate configuration to mate with a jack fitting (not shown).

The apparatus 30 is secured to the aprons 8 and 10 by appropriate brackets, details of which are shown in FIGS. 3, 4, 5, and 6.

FIG. 3 is a perspective view of a portion of the aprons 8 and 10, illustrating four of the brackets associated with the apparatus 30. The four brackets include an end bracket 100, a spring bracket 110, a corner bracket 120, and a spring bracket 140. In FIG. 3, the end bracket 100 is shown, the spring brackets 410 and 140 are shown, and the corner bracket 120 is shown.

FIG. 4 is a view in partial section of the spring bracket 110, taken generally along line 4—4 of FIG. 3. FIG. 5 is a view in partial section taken generally along line 5—5 of FIG. 3. The end bracket 100, the spring bracket 110, the corner bracket 120, and the spring bracket 140 are shown.

FIG. 6 is a perspective view of a portion of the apron 8, illustrating a fifth bracket, a spring bracket 130. The spring bracket 130 is secured to the apron 8 adjacent to the bow 58 and the end 60 of the rod 50.

For the following general discussion, reference will primarily be made to FIGS. 1-6.

The base member or rod 32 includes a flat end 34. The base member or rod 32 is disposed within the end clamp 100 and within the spring clamp 110. The bracket 100 limits the rearward travel of the rod 32, and the corner bracket 122 limits the forward travel of the rod 32. Thus, the brackets 100 and 120 confine the apparatus 30 when it is used as a hood support element and help to hold the apparatus 30 when it is stowed. (See FIG. 2.)

The end bracket 100 is a generally U-shaped bracket. It includes a base element or portion 102 and two arms 104 and 106 extending upwardly from the base element 102. A screw 103 extends through the base element 112 to secure the bracket 100 to the apron 10.

The arm 106 includes an aperture or hole 108 through which the end portion of the rod 32 extends. The end 34 of the rod 32 abuts the arm 104 to limit the movement of the rod 32 and the apparatus 30 in a rearward direction.

The corner bracket 120 is of a generally L shaped configuration. It includes a horizontally extending base portion 122 and a vertically extending arm portion 124. A pair of screws 126 is used to secure the base 122 to the apron 8. The vertical arm 124 is disposed generally parallel to the arm portion 38. The center of the arm 124 is generally aligned with the spring bracket 110. The plate or arm 124 limits the forward movement of the apparatus 30. The elbow 36 abuts the arm 124 to limit the movement and to brace the apparatus 30 when the apparatus 30 is used to support the hood 6 by pivoting the rod 50 through ninety degrees from its stowed position to the upright position. This is shown in FIG. 1.

The spring bracket 110 (See FIG. 4) includes a base 112 disposed on the apron 10 and secured thereto by a screw 118. A pair of spring arms 114 and 116 extend upwardly from the base 112. The rod 32 is disposed within the spring bracket 110 and is held therein by the generally inwardly directed bias of the arms 114 and 116.

Remote from the corner bracket 120 is the spring bracket 130. The spring bracket 130 is best illustrated in FIG. 6. The spring bracket 130 is substantially identical to the spring bracket 110. The bracket 130, shown in an enlarged perspective view in FIG. 6, includes a base portion 132 and a pair of arm portions 134 and 136 secured to the base 132 and extending upwardly therefrom. A screw 138 extends through the base 132 to secure the base 132 to the apron 8. In its down or stowed position, the extension rod 50 is disposed in the bracket 130 and is held therein by the generally inwardly directed spring bias of the arms 134 and 136. The spring bracket 130 is disposed relatively close to the bow 58 and to the end portion 60 of the rod 50.

The rod portions 32 and 38 are joined together by an elbow 36 as discussed above. The elbow 36 comprises a substantially ninety degree turn, and the rod portions 32 and 38 are accordingly substantially perpendicular to each other.

The rod portions 38 and 50 are secured together by a sleeve 70. Details of the sleeve 70 and the juncture of the rod portion 38 and 50 are shown in FIGS. 7 and 8. FIG. 7 is an enlarged view of the sleeve 70, and the rod portions 38 and 50. FIG. 8 is a view in partial section taken generally along line 8–8 of FIG. 7.

The rod portion 38 terminates in a blade end 40. The blade end 40 is designed to comprise a pry tool for removing wheel covers, hub caps, and the like. In order to utilize the blade end 52, the sleeve 70 is released to allow the rod portions 38 and 50 to be separated from each other. In order to accomplish the separation, the apparatus 30 is removed from the brackets 100, 110, 130, and 140, and the sleeve 70 is then released to allow the rod portions 32 and 38 to be separated from the rod portion 50.

The rod portion 50 includes a socket or blade seat end 52 for receiving the blade end 40 of the rod portion 38. The socket blade seat end 52 receives the blade end 40, and the two portions are locked together by the sleeve 70. Adjacent to the seat 52 is a circumferentially extending groove 54 in the rod 50. The circumferentially extending groove 54 cooperates with the sleeve 70.

The sleeve 70 is a generally cylindrical element which includes an end 72 disposed over the rod portion 38. Extending longitudinally or axially with respect to the sleeve 70 from the end 72 is a lug slot 74. The lug slot 74 includes a circumferentially extending portion 76, remote from the end 72. At the end of the circumferentially extending slot 76, remote from the slot 74, is a relatively short longitudinally or axially extending locking lug slot 78.

At the opposite end of the sleeve 70 from the end 72 is a radially inwardly extending end wall 80. The end wall 80 is disposed within the circumferentially extending slot or groove 54. An opening 82 extends through the wall 80. The opening 82 is diametrically larger than the rod 50 at the groove 54, but the opening is not diametrically as large as the rod portion 50.

Within the slot 54 is a compression spring 84. The compression spring 84 extends between the groove 54 and the end wall 80 to bias the sleeve to lock the rod portions 38 and 50 together.

A radially extending locking lug 44 extends outwardly from the arm 38 adjacent to the blade end 40. The locking lug 44 cooperates with the slots 74, 76, and 78 of the sleeve 70 to lock the sleeve 70 in place over the rod portions 38 and 50. The compression spring 84 biases the sleeve to maintain the locking lug 44 in the slot 78.

For releasing the rod portions 38 and 50, as may be visualized in FIGS. 7 and 8, the sleeve 70 is moved against the bias of the spring 80 axially to move the lug 44 out of the slot 78 and into the circumferentially extending slot 76. The sleeve 70 is then rotated to move the lug 44 into the slot 74. With the lug 44 in the slot 74, the rod portion 38 may be removed from the blade seat or socket 52. With the rod portion 38 removed, the rod portion 38, secured to the rod portion 32, may then be used as desired. However, since the end wall 80 is disposed within the groove 54, the sleeve 70 will be retained on the rod portion 50. The rod portions 38 and 32 have two separate functions, one of which, the use of the tip 40 as a pry tool, has been discussed. The second function will be discussed next.

In addition to the blade end 40, the rod portions 32 and 38 include another tool which comprises a dual functioning element, namely a crank handle/lug wrench combination element 90. The element 90 includes a socket 92 at its outer end. The socket 92 comprises a lug wrench socket for removing lug nuts on the wheels of the vehicle 2.

Remote from the socket 92 is an end 94. The end 94 includes an aperture 96 extending through it. The rod portion 32 extends through the aperture 96. The crank handle/lug wrench element is retained on the rod 32 by a radially extending locking lug 42. The locking lug extends outwardly from the rod 32. The locking lug 42 is disposed between the crank handle/lug wrench element 90 and the end 34 of the base member or rod 32. As best shown in FIG. 2, the locking lug 42 is disposed adjacent to the arm 106 of the end bracket 100.

With the rod portions 32 and 38 removed from the rod portion 50, the crank handle/lug wrench element 90 is available for use in removing and tightening/installing lug nuts against wheels. The rod portion 32 and the rod portion 38 provide desired leverage for removing and/or installing the lug nuts, as desired by the user of the apparatus. The lug wrench element 90 is disposed adjacent to its locking lug 42 to provide a maximum lever arm between the lug wrench 90 and the rod 38. On the other hand, if desired, the lug wrench element 92 may be moved along the rod portion 32 to a central location to allow equal lever arms on opposite sides of the lug wrench 90 on the rod 32.

For storage, the crank handle/lug wrench element 90 is disposed in the spring bracket 140. Since the diameter of the element 90 is greater than that of the rods 32 and 50, the spring bracket 140 is slightly larger. Otherwise, the spring bracket 140 is substantially identical to the spring brackets 110 and 130.

The spring bracket 140, as best shown in FIG. 5, includes a base element 142 and a pair of arms 144 and 146. The spring bracket 140 is secured to the apron 10 by a screw 148. The screw 148 extends through the base element 142.

For joining together the rod portions 38 and 50, the reverse of the operation steps discussed above is employed. The blade 40 is inserted into the socket 52, and the slot 74 of the sleeve 70 is aligned with the locking lug 44. The locking lug 44 is then moved in the slot 74. The sleeve 40 is moved axially against the compression spring 84 and is then rotated to move the locking lug 44 in the slot portion 76. The lug portion 44, as it is aligned with the axially extending slot 78, is then locked in the slot 78 by releasing the sleeve 70. The bias of the compression spring 84 moves the sleeve 70 axially with respect to the rods 38 and 50 to lock the lug 44 in the slot portion 78. The sleeve 70 is thus secured to both the rod portions 38 and 50 to secure the rod portions 38 and 50 together.

With the rod portions 38 and 50 secured together, the apparatus 30 may then be used as a crank rod for cranking the scissors-type jacks which are typically used in pickup trucks and the screw-type jacks also used in such vehicles.

The use of the apparatus 30 as a crank element is accomplished by removing the apparatus 30 from its brackets 100, 110, 130, and 140. The square end portion 60 is inserted into the appropriate jack receptacle, and the crank handle/lug wrench 90 is pivoted 180 degrees from the position shown in FIGS. 1 and 2. The combination element 90 then becomes a crank handle with the rod portion 32, between the elbow 36 and the crank handle 90, comprising the lever arm for the crank.

FIG. 9 is a perspective view of an alternate end bracket 150 which may be used in place of the end bracket 100. The alternate end bracket 150 includes a base portion 152 and a pair of arms 156 and 160. The base 152 includes an aperture 154 extending through it. The aperture 154, of course, receives a screw (not shown) to secure the bracket 150 to the apron 10.

The arm 156 includes a slot 158 to receive the rod portion 32. For using the bracket 150, it would be preferable to have a relieve portion on the rod 32 so that the relieved portion may extend through the opening or slot 158. Then, when the rod 160 is pivoted, the relieve portion is rotated so that the wide portion of the rod 132 is disposed transversely within the widened portion of the slot 158. Or, in the alternative, the bracket 150 may be made of an elastomeric material, with the arm 156 and its slot 158 able to deform or receive the upper portion of the slot 158 when the rod 132 is moved into the slot 158. The arm 160 acts as a stop element for limiting the rearward movement of the apparatus, just as does the arm 104 of the bracket 100.

It will be noted that the blade end 40 has been described as being on the end of the arm 38. This, of course, necessitates the blade seat 52 on the end of the extension rod 50. If desired, the blade end 40 could be located on the base member or rod 32 in place of the flat end 34. In such case, the flat end 34 would be located on the end of the arm 38. Instead of a flat end 34 on the arm 38, the end could be configured as desired for convenient securing to the extension arm 50. A sleeve, such as the sleeve 80, or some other appropriate sleeve-like member, would still be used to connect the extension rod 50 to the arm 38.

In case of the transposition of ends, as discussed in the preceding paragraph, the crank handle/lock wrench element 90 would, when the base member 32 and its arm 38 is used as a pry tool, be moved to a location substantially adjacent to the arm 38.

Moreover, the juncture or joint between the extension rod 50 and the base element or arm 32 could be at the elbow 36, if desired. This design would, of course, obviate the need for the relatively short arm 38. With this design, the blade end 40 could still be located at either end of the base arm 32. Again, an appropriate joint or securing element(s) would be used to secure the arms together.

Finally, it will also be noted that the juncture between the extension rod 50 and the base arm 32 could be a socket joint. In such case the arm 38 would comprise a lug wrench, with its socket receiving the mating end of the arm 50. A crank handle element, in place of the element 90, would still be employed. Essentially, this configuration would substitute the element 90 for the arm 38. However, for convenience, the substitution would still require that the crank arm be movable relative to the base arm or element 32 for the reason discussed above, such as the need for a stowed position and a crank position.

FIG. 10 is a perspective view of a portion of the vehicle 2, showing the engine compartment 4, the front apron 8, and the side apron 10. FIG. 10 also discloses an alternate embodiment comprising combination apparatus 200 disposed on the front apron 8 and on the side apron 10. The apparatus 200 includes a lug wrench 202 and an extension member or rod 230.

FIG. 11 is perspective view of the apparatus 200 of FIG. 10 with the extension member or rod 230 pivoted from its stored position, as shown in FIG. 10, to its up position where it supports the hood (see FIG. 1).

FIG. 12 is a view in partial section taken through a portion of the lug wrench 202 and the rod 230, taken generally along line 12—12 of FIG. 1. FIG. 13 is a top view of the elements illustrated in FIG. 12. For the following discussion of alternate embodiment 200, reference will primarily be made to FIGS. 10, 11, 12, and 13.

The lug wrench tool 202 includes a socket 204 which receives lug nuts for loosening and tightening the lug nuts. The socket 204 is on one end of a relatively short arm 206. The arm 206, as will be discussed below, becomes a handle when using the apparatus 200 as a jack crank.

The short arm 206 is secured to a long arm 210, a lever arm for the wrench tool, through an elbow 208. The arms 206 and 210 are disposed substantially perpendicularly to each other. The distal end of the long arm 210 includes a blade end or pry tip 216. The tip or end 216 is remote from the short arm 206.

Adjacent to the tip or end 216 of the arm 210 is a reduced diameter portion or relieved portion 212. A key 214 is disposed adjacent to the reduced diameter portion 212. The key 214 extends longitudinally on the arm 210.

The extension member or rod 230 includes an eye end 232. The eye end 232 comprises a circular eye which includes a key slot 234 extending generally parallel to the rod portion 230.

The inner diameter of the eye 232, not including the key slot 234, is generally about the same as, or slightly greater than, the outer diameter of the arm 210. The appropriately sized or dimensioned elements 210 and 232 allow the rod 230 to be removed from the lug wrench 202 when the lug wrench is going to be used to remove wheel covers, hub caps, lug nuts, etc.

The reduced diameter portion 212 of the arm 210 is substantially less in diameter than the eye 232. Thus, when the arm 230 is used to support the hood 6 (see FIG. 1), the rod 230 is moved until the eye 232 is disposed over the reduced diameter portion 212. The overall length of the reduced diameter portion 212 is such that the rod 230 may be conveniently or easily tilted at an acute angle with respect to the rod 210, as shown in FIG. 11, to provide the necessary support for the hood.

The lug wrench 202 is disposed on the apron 10 and is held in place by a pair of clips 250 and 252. A stop bracket 254, which is merely an angle bracket, is disposed adjacent to the clip 252 for comprising a stop element to limit the forward movement of the lug wrench 202. The bracket 254 includes two arms, an upwardly extending arm and an arm disposed on the apron 8. The tip or blade end 216 is preferably disposed against the upwardly extending arm of the stop bracket 254.

When the apparatus 200 is to be used as a jack crank, the lug wrench portion 202 and the rod portion 230 are removed from the aprons 8 and 10 of the truck 2. The outer end of the rod 230 (not shown), remote from the eye 232, is inserted into a mating portion of the jack (not shown) and the arm 210 of the lug wrench portion 202 is moved until the key 214 extends into the key way 234 of the eye 232. With the key 214 in the key way 234, the rod 230 and the lug wrench 202 are locked together for joint rotation.

With the apparatus 200 locked together, the short arm 206 becomes a handle which a user grasps in order to rotate the apparatus 200. The lever arm for the jack crank comprises the distance between the key 214 (and the key way 234) and the handle 206. The user simply rotates the arm 206 which becomes a jack handle in order to raise or lower the attached jack.

When the desired jack activities have been accomplished, the rod 230 is removed from the jack, and the long arm 210 is moved relative to the eye 232 to disengage the key 214 from the key way 234. The lug wrench 202 may then be moved relative to the extension member or rod 230, as desired. For storage purposes, the elements 202 and 230 are again disposed on the aprons 8 and 10 of the vehicle 2, as shown in FIG. 10.

In FIGS. 14 and 15, an alternate embodiment or configuration of the connection of the lug wrench and extension rod is illustrated. FIG. 14 is a view in partial section through a lug wrench embodiment 220 illustrating the securing of the lug wrench 220 with an extension member or rod 230. FIG. 15 is a top view of a portion of the lug wrench 220 and the extension rod 240 shown in FIG. 14. For the following discussion, reference will primarily be made to FIGS. 14 and 15.

The lug wrench 220 includes a long arm 221 with a reduced diameter portion 222. Adjacent to the reduced diameter portion 222 is a square shank portion 224. From the square shank portion 224, an end shank portion 226 extends to a blade end or tip 228. It will be noted that the end shank portion 226 is of a lesser diameter than the arm portion 221 in order to allow the movement of the rod 240 along the shank 226 to separate the lug wrench portion 220 from the extension rod 240.

The extension member or rod 240 includes an eye end 242. The interior of the eye end 242 comprise a square socket 244. The square socket mates with the square shank portion 224 of the lug wrench 220 to lock together or to secure together the lug wrench 220 and the rod 240 for joint movement, as required for cranking purposes.

Again, the overall length of the reduced diameter portion 222 of the lug wrench 220 is sufficient to allow the rod 240 to move or pivot, as desired, for supporting the hood (see FIG. 1) as desired.

As discussed above, the end shank portion 226 of the lug wrench 220 is of a diameter substantially the same as or less than the distance between the flats of the square shank portion 224 in order to allow relative movement between the eye 244 and the shank 226 in order to disengage or to separate the lug wrench 220 from the rod 240.

For utilizing the lug wrench 220 as a crank handle, the square socket 244 of the eye 242 is placed over the square shank portion 224. With the two elements secured together, the length of the arm 221 between the eye 244 and the outer end, and short arm (not shown) of the lug wrench 220 becomes the lever arm for rotating the rod 240, as discussed above in conjunction with the other embodiments.

FIG. 16 is a view in partial section through another alternate embodiment of a portion of the apparatus of the present invention, illustrating another form of clip for securing the rod 230 the apron 10 when the lug wrench 202 is stored elsewhere. For example, if it is desired to store the lug wrench 303 in a tool kit, etc., rather than on the apron 10, then the rod 230 may simply be secured to the apron 10 by means of a clip and a removable pin. Illustratively, a clip 260 is shown secured to the apron 10 by means of a screw 268.

The clip 260 is of a generally U-shaped configuration which includes base plate 262 and a pair of vertically or upwardly extending arms 264 and 266. The horizontal base 262 is disposed on the apron 10, and the screw 268 extends through the horizontal base 262 to secure the clip 260 to the apron 10. The vertical arms 264 and 266 include apertures through which a pin 270 extends, and for which the pin is secured. A chain 272, or the like, may in turn be used to appropriately hold the locking pin 270 to the apron 10, as desired.

The pin 270 extends through the eye 232 at the end of the rod 230. The distance between the upright arms 264 and 266 allow the rod 230 to tilt as required to support the hood (not shown) when the rod 230 is pivoted upwardly from the down, stored position shown in FIG. 10 to the up position, supporting the hood.

The substantial difference between the embodiment of FIG. 16 and the embodiment of FIGS. 10 and 11 is that the pin 270 is substituted for the lug wrench arm 210 and its reduced diameter portion 212, thus allowing the wrench 202 to be located and stored elsewhere. Moreover, under such circumstances, the reduced diameter portion 212 is not needed. However, in order to use the lug wrench 202 as a handle for the jack crank, there must still be cooperating locking elements to secure the rod 230 to the lug wrench 202 for joint rotation.

FIG. 17 is a view in partial section through another locking clip which may be used to secure the rod 230 to the apron 10, when the lug wrench 202 is stored elsewhere than on the apron 10. A clip 280 is used, with the clip 280 secured to the apron 10 by means of a screw 282, and the eye 232 disposed in the clip 280.

The clip 280 includes a base portion 284, an upwardly extending wall 286, and a top portion 288 extending outwardly from the wall 286. The top portion 288 includes an outer portion 290 and a lower bottom locking portion 292.

Secured to the base 284 is a latching portion 294 that is secured to the base 290 by a living hinge 296. When it is desired to release the top portion 288, and the outer portion 290, the latch 294 is moved outwardly, as illustrated in phantom in FIG. 17, to release the locking portion 292. With the clip 280 being made of elastomeric material, the portions 288, 290, and 292 may be conveniently moved or pivoted outwardly on the wall 286 to release the eye 232 of the rod 230. The eye 232 of the rod 230 is then locked in the clip 280 in the reverse manner. That is, the portions 288, 290, and 292 are disposed through the eye 232, and the latching portion 294 is moved into engagement with the locking portion 292.

The configuration of the clip apparatus 280 allows the eye 232 and the rod 230 to pivot as required for supporting the hood of the vehicle 2. The rod 230 and the eye 232 may easily pivot in two planes, as required, for storing and using the rod 230. The clip 280 may also be easily opened or unlatched to remove the rod 230 when using the rod 230 as a jack crank.

FIG. 18 is a perspective view of another alternate embodiment of the apparatus of the present invention. FIG. 19 is a view in partial section taken generally along line 19—19 of FIG. 18. For the following discussion, reference will primarily be made to FIGS. 18 and 19.

A portion of a lug wrench 300 is illustrated in both FIGS. 18 and 19. The lug wrench 300 includes, for purposes of the present invention, an arm 302 and a tip or blade end 304. The arm 302 is generally of a uniform diameter except for the tip or blade end 304.

An extension member or rod 310 is secured to a sleeve 320. The sleeve 320 includes a pair of arms 322 and 324 which are generally parallel to each other. The sleeve 320 extends about the shaft or arm 302 of the lug wrench 300.

The extension member or rod 310 includes a flattened and apertured end 312 which is disposed between the arms 322 and 324. A pin 326 is used to secure the extension member or rod 310 to the sleeve 320. The pin 326 extends through the flattened and apertured end 312 and through the arms 322 and 324. The pin 326 allows the rod 310 to pivot relative to the arm 302, as when the rod 310 is used to support a hood, as shown in FIGS. 1 and 11. At the same time, the sleeve 320 restricts the rotary movement of the rod 310 and the arm 302 when the lug wrench 300 and the extension member or rod 310 are used as a crank element.

The sleeve 320 is preferably made of spring steel, or the like, such that the fit between the sleeve 320 and the arm 302 is loose enough to allow the sleeve to rotate on the arm 302 to use the rod 310 as a hood support. The fit is also loose enough to allow the lug wrench arm 302 to be removed from the sleeve 320 and from the rod 310 when it is desired to use the lug wrench 300 as a lug wrench, pry tool, etc. For utilizing the rod 310 and the lug wrench 300 as a rotary tool for raising and lowering a jack, the sleeve 320 is, of course, disposed about the arm 302 to secure the two elements together for joint rotation, as discussed above with respect to the other embodiments.

In the embodiment of FIGS. 14 and 15, a square shank and eye have been discussed. Obviously, any noncircular mating configuration may also be used. The diameter or configuration of the outer end of the long arm would have to be appropriately configured and/or dimensioned in order to allow for the separation and the securing together of the support rod and the lug wrench elements.

While the principles of the invention have been made clear in illustrative embodiments, there will be immediately obvious to those skilled in the art many modifications of structure, arrangement, proportions, the elements, materials, and components used in the practice of the invention, and otherwise, which are particularly adapted to specific environments and operative requirements without departing from those principles. The appended claims are intended to cover and embrace any and all such modifications, within the limits only of the true spirit and scope of the invention.

What I claim is:

1. Hood support and lug wrench tool apparatus convertible to a jack crank for raising and lowering a jack, comprising, in combination:

support rod means for supporting a vehicle hood, including a first end securable to the jack and a second end;

lug wrench tool means having a first arm and a socket on the first arm for receiving lug nuts and having a second arm comprising a lever arm for the first arm and the socket for loosening and tightening lug nuts and securable to the second end of the support rod means; and means for securing the second end of the support rod means to the second arm to comprise a jack crank.

2. The apparatus of claim 1 in which the means for securing the second end of the support rod means to the second arm includes an eye having a noncircular configuration, and a shank having a noncircular configuration for matingly extending into the eye to secure the support rod means and the lug wrench tool means together for joint movement as a jack crank.

3. The apparatus of claim 1 in which the means for securing the second end of the support rod means to the second arm includes a shank portion on the second arm of the lug wrench tool means, an eye on the second end of the support rod means for receiving the shank portion of the second arm, and means for securing the shank portion to the eye for joint rotation of the lug wrench tool means and the support rod means to comprise a jack crank.

4. The apparatus of claim 3 in which the means for securing the shank portion to the eye includes a key slot in the eye and a key on the shank.

5. The apparatus of claim 3 in which the means for securing the shank portion to the eye includes a noncircular portion on the shank and the eye includes a mating noncircular portion for receiving the noncircular portion of the shank.

6. The apparatus of claim 1 in which the means for securing the second end of the support rod means to the second arm includes a sleeve secured to the second end and disposed on the second arm for securing together the rod means and the lug wrench tool means for joint use as a jack crank and removable from the second arm for using the support rod means and the lug wrench tool means separately.

7. The apparatus of claim 1 in which the second end of the support rod means includes an eye, and the second arm of the lug wrench tool means includes a relieved portion extending into the eye for allowing the support rod means to pivot on the second arm.

8. The apparatus of claim 7 in which the second arm of the lug wrench tool means further includes means adjacent to the relieved portion for locking the second arm to the eye for joint movement of the support rod means and the lug wrench tool means as a jack crank.

* * * * *